United States Patent [19]

Würmli

[11] 4,067,088

[45] Jan. 10, 1978

[54] APRON DRAFTING ARRANGEMENT

[75] Inventor: Arthur Würmli, Winterthur, Switzerland

[73] Assignee: Rieter Machine Works Ltd., Winterthur, Switzerland

[21] Appl. No.: 715,930

[22] Filed: Aug. 19, 1976

[30] Foreign Application Priority Data

Sept. 12, 1975 Switzerland ..... 11887/75

[51] Int. Cl.[2] ..... D01H 5/86

[52] U.S. Cl. ..... 19/253; 19/295

[58] Field of Search ..... 19/258, 266, 267, 281, 19/282, 244–256, 295

[56] References Cited

U.S. PATENT DOCUMENTS

| | | | |
|---|---|---|---|
| 2,931,074 | 4/1960 | Noguera | 19/255 |
| 3,120,681 | 2/1964 | Stahlecker | 19/252 |

FOREIGN PATENT DOCUMENTS

| | | | |
|---|---|---|---|
| 908,590 | 4/1954 | Germany | 19/252 |
| 946,875 | 8/1956 | Germany | 19/295 |
| 953,590 | 12/1956 | Germany | 19/253 |
| 1,080,911 | 4/1960 | Germany | 19/281 |
| 494,898 | 6/1954 | Italy | 19/251 |
| 898,803 | 6/1962 | United Kingdom | 19/295 |
| 945,436 | 12/1963 | United Kingdom | 19/244 |
| 364,698 | 2/1973 | U.S.S.R. | 19/256 |

*Primary Examiner*—Dorsey Newton
*Attorney, Agent, or Firm*—Werner W. Kleeman

[57] ABSTRACT

An apron drafting arrangement for fibrous material comprising a pair of back rolls, a pair of intermediate rolls, a pair of front rolls, the intermediate pair of rolls including a top roll and bottom roll. Deflecting elements are arranged to each side of such top roll and a top apron is loosely placed about the top roll and about such deflecting elements. The deflecting elements, viewed in the direction of material flow, are located upstream and downstream of the top roll of the intermediate pair of rolls. A top apron guide cage takes up the top intermediate roll and the deflecting elements and a bottom apron is loosely guided about a respective deflecting element located upstream and downstream of the bottom roll of the pair of intermediate rolls. The intermediate pair of rolls is arranged closer to the downstream located deflecting elements.

16 Claims, 3 Drawing Figures

APRON DRAFTING ARRANGEMENT

BACKGROUND OF THE INVENTION

The present invention relates to a new and improved construction of an apron drafting arrangement comprising a pair of back rolls, a pair of intermediate rolls and a pair of front rolls. A top apron is placed loosely about the top roll of the intermediate pair of rolls and about a respective deflecting guide element which, as seen in the direction of material flow, are located upstream and downstream of the top roll of the intermediate pair of rolls, there being further provided a top apron guide cage for taking-up or housing the top intermediate roll and the deflecting elements.

A three-roll drafting arrangement is already known to the art from German Pat. No. 521,181 wherein the lower run of the top apron is deflected by rigid deflecting elements located upstream and downstream from, and parallel to, the top intermediate roll. The roving subject to draft in this manner is contactingly guided in an arc over a somewhat greater zone of the bottom intermediate roll than otherwise possible with linear contact of the intermediate top and bottom rolls without aprons.

Drafting arrangements of this type are associated with the disadvantage that the contact zone covered by the arc length of the top apron at the bottom intermediate roll is limited due to the roll arrangement of the drafting arrangement and upstream and downstream of the nip of the pair of intermediate rolls only a limited arc can be utilized for guiding the roving.

On the other hand, a large wrapping angle at the intermediate roll would be disadvantageous, since then the roving would be sharply deflected while entering and leaving the zone between the apron and the intermediate roll instead of meeting the roll tangentially.

Widespread applications have been found for apron drafting arrangements of the type in which the aprons are deflected downstream by a deflecting rail, the second deflecting being effected by the intermediate rolls themselves. In order to obtain a long guiding zone with this arrangement the distance between the deflecting element and the intermediate roll is also chosen to be correspondingly large.

Such apron drafting arrangements exhibit considerable disadvantages since in the zone between the nip of the intermediate rolls and the deflecting elements the aprons are "pushed" and thus the danger of "wave formation" is exceptionally pronounced in this zone and the drafting zone of the roving can be disturbed. Additional tensioning springs provided for the aprons can counteract the "wave formation" to some extent, but with such measures the friction at the aprons is increased such that, on the one hand, the energy consumption of the apron drive increases and, on the other hand, the life of the aprons is unpermissibly shortened.

SUMMARY OF THE INVENTION

Hence, it is a primary object of the present invention to eliminate the disadvantages of heretofore known drafting arrangements and to provide an apron drafting arrangement wherein, the roving or other material to be drafted, is guided by aprons throughout as long as possible zone and into close vicinity to the nip line of the front roll pair.

Now in order to implement this object and others which will become more readily apparent as the description proceeds, the apron drafting arrangement of the invention is manifested by the features that a bottom apron is loosely guided over a respective deflecting element arranged upstream and downstream of the pair of intermediate rolls and said intermediate pair of rolls is arranged closer to the downstream or front deflecting elements.

BRIEF DESCRIPTION OF THE DRAWINGS

The invention will be better understood and objects other than those set forth above, will become apparent when consideration is given to the following detailed description thereof. Such description makes reference to the annexed drawings wherein the schematic circuit diagram illustrates an exemplary embodiment of the invention in the idling position.

DETAILED DESCRIPTION OF THE PREFERRED EMBODIMENTS

Figure 1:
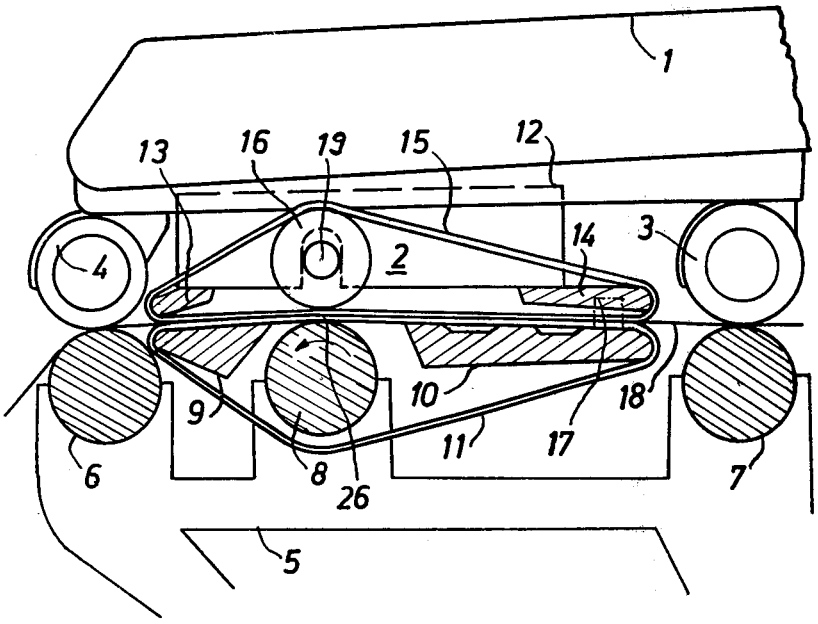
FIG. 1 is a side view of the drafting arrangement constructed according to the invention and in partial section.

Describing now the drawings, it will be seen from the showing of FIG. 1 that there are mounted on a supporting or support arm 1 of a double apron drafting arrangement 2, as seen in the direction of material flow, a back roll (or input or infeed roll) 3 and a front roll (or delivery roll) 4. At a spinning machine frame 5, upon which there is also pivotably mounted in conventional manner the support arm 1, there are provided a driven front bottom roll 6 and a driven back bottom roll 7. The pivotal support arm 1 can be selectively shifted between the illustrated working position of FIG. 1 and a raised position as will be explained later.

Between the two rolls 6 and 7 there is rigidly mounted a driven intermediate bottom roll 8 and upstream and downstream of this roll 8, there is rigidly or fixedly mounted a respective apron deflecting element each 9 and 10. An endless apron 11 loosely surrounds both the deflecting elements 9 and 10 and the intermediate bottom roll 8. On the support arm 1, between the top rolls 3 and 4, there is detachably and pivotably inserted a top apron guide cage 12 as will be explained more fully hereinafter. A respective front and back apron deflecting element 13 and 14 are rigidly connected in any convenient fashion, as by welding, screws, bolts or the like, generally indicated by reference character 30, to the cage 12 and form the guide means for a top apron 15 which also loosely surrounds the intermediate top roll 16 supported between the deflecting elements 13 and 14. On the deflecting element 10, which also forms a supporting bridge for the bottom apron 11, there are provided laterally of the aprons 11 and 15 two guide members 17 which guide the two aprons 11 and 15 in parallel superimposed relationship. The roving is designated by reference character 18.

The shaft or axle 19 of the intermediate top roll 16 (FIGS. 2 and 3) is guided in a vertical slot 23 of the cage 12 and by means of a spring 20 which is mounted on the deflecting element 14 is held elastically or resiliently shiftable in the slot 23.

Figure 2:
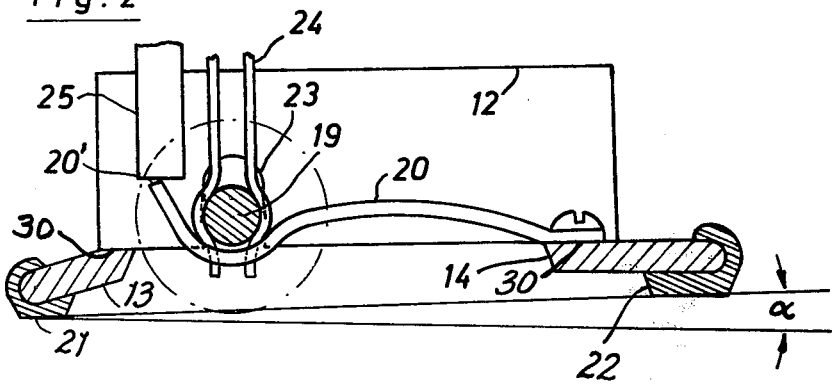
FIG. 2 is an enlarged longitudinal section through the middle of the top apron cage (the supporting arm and the apron not being shown), and shown in its working position.
Figure 3:
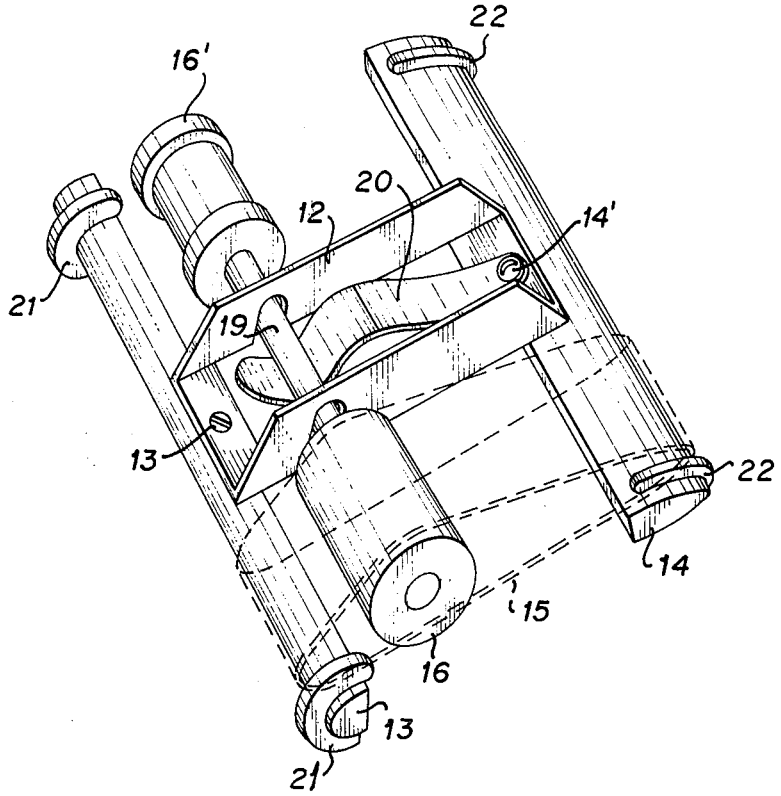
FIG. 3 is a perspective view of the top apron cage of FIG. 2.

As best seen in FIG. 2, the spring 20 also performs the function of holding the cage 12 into a position where it is slightly inclined (angle 2) towards the front when the supporting or support arm 1 assumes its pivoted-up position and the cage 12 is lifted-off or raised, because the front end 20' of the spring 20 is formed such that it contacts a projection 25 of the supporting arm 1 and prevents backward shift of the roving as the supporting arm is pivoted into its operative or working position. Furthermore, the spring 20 prevents the intermediate roll 16 (or 16') from dropping out of the cage 12 when the cage 12 is lifted-off the supporting arm 1, e.g. during exchange of the apron or the intermediate roll. The cage 12 is pivotably mounted through the agency of the shaft 19 upon the supporting arm 1 by means of a snap-locking device 24 or any other equivalent structure.

Moreover, at the two apron deflecting elements 13 and 14 of the cage 12 there are exchangeably mounted spacer members 21 and 22 which determine the distance between the top and bottom deflecting elements 13, 9 and 14, 10 and between the top apron 15 and bottom apron 11 respectively.

By means of the spring 20 the cage 12, mounted upon the supporting or support arm 1, together with its deflecting elements 13 and 14 and the spacer or spacing members 21 and 22 is elastically supported at the bottom deflecting elements 9 and 10. The spacer or spacing members 21 and 22 permit adaptation of the distance between the top and bottom deflecting elements and between the top and bottom aprons to the material to be processed.

Thus, shaft 19 of roll 16 is rigidly held by snap-locking device 24. Cage 12 is slidable and pivotably guided by means of vertical slot 23 on shaft 19 and elastically held therein by spring 20. When the support arm 1 is lifted the cage 12 moves by means of the spring 20 in the slot 23 until shaft 19 is the end position of the slot 23. In other words cage 12 moves by means of the spring 20 in the slot 23 until shaft 19 is the end position of the slot 23. In other words cage 12 and the deflecting elements are pushed downwards relative to the shaft 19 of roll 16, the support arm respectively.

When the support arm 1 is in working position cage 12 is elastically pressed with spacer elements 21 and 22 towards the lower deflecting elements 9 and 10 by the force of spring 20.

The nip line or nip 26 of the intermediate rolls 8 and 16 is located somewhat above the connecting line between the two bottom apron deflecting elements 9 and 10 in such a manner that the throughpassing roving 18 can be uniformly guided at each point by the two aprons 11 and 15. Also, as mentioned, these intermediate rolls 8 and 16' are located closer to the downstream located deflecting or deflection elements 9 and 13, for instance within the front third of the zone between the deflecting elements 9, 13 and 10, 14. The drive of the aprons is effected by the bottom intermediate roll 8 as in known drafting arrangements, and therefore to simplify the illustration has not been particularly shown.

If the cage 12 is detached, the intermediate roll 16 with its cylindrical sleeve surface (solid roll) can be taken-off the cage 12 in simple manner without tools and can be replaced by an intermediate roll 16 the sleeve surface or shell of which is cut out (hollow roll or slip draft roll) for processing long staple material, or vice versa. Thus, intermediate roll 16 can be considered to embody any of these various constructions.

The invention heretofore described possesses a number of advantages over the initially described known drafting arrangements:

a. The roving is uniformly guided between the back and front rolls from the top and from the bottom over the whole zone.

b. The "pushed" portion of the apron, i.e. the apron portion between the intermediate roll and the deflecting element facing the delivery or front roll, is very short in comparison to the whole portion guiding the roving, and thus no wave formation occurs.

c. No tensioning spring is required for tensioning the aprons, thus less apron friction is generated, and hence, less apron wear occurs, and furthermore, the top apron is always evenly pressed against the bottom apron owing to the low friction at the back deflecting elements.

d. Drafting of short staple material in two drafting zones or drafting of long staple material in one long, guided zone is possible under the same drafting arrangements and by exchanging the intermediate rolls.

While there are shown and described present preferred embodiments of the invention, it is to be distinctly understood that the invention is not limited thereto, but may be otherwise variously embodied and practiced within the scope of the following claims. Accordingly,

What is claimed is:

1. An apron drafting arrangement for fibrous material moving in a predetermined direction of material flow, comprising a pair of back rolls, a pair of intermediate rolls, a pair of front rolls, the intermediate pair of rolls including a top roll and bottom roll, a top apron guide cage comprising a pair of non-rotatable top deflecting elements connected to said cage in spaced relation, a top apron loosely placed about the top roll of the intermediate pair of rolls and about said pair of top deflecting elements, said top pair of deflecting elements, viewed in the direction of material flow, including a respective one of said deflecting elements located upstream and downstream of the top roll of the intermediate pair of rolls, said top apron guide cage including means for receiving the top intermediate roll, a pair of bottom deflecting elements including a respective one of such deflecting elements located upstream and downstream of said bottom roll of said intermediate pair of rolls, a bottom apron loosely guided about said deflecting elements of said second pair of deflecting elements which are located upstream and downstream of the bottom intermediate roll, the intermediate pair of rolls being arranged closer to the downstream located deflecting elements, said top and bottom aprons including a respective lower and upper run disposed in confronting relationship between said pairs of deflecting elements located upstream and downstream of said intermediate rolls to provide a supported travel path for said fibrous material moving from between one pair of deflecting elements to another pair of deflecting elements.

2. The apron drafting arrangement as defined in claim 1, further including means for elastically supporting the first pair of top deflecting elements of the top apron at the second pair of bottom deflecting elements of the bottom apron.

3. The apron drafting arrangement as defined in claim 1, further including means for rigidly connecting the top deflecting elements with the top apron guide cage, and means for elastically connecting by means of a spring the top intermediate roll with said cage.

4. The apron drafting arrangement as defined in claim 1, wherein the intermediate pair of rolls is arranged within the front third of the zone between said deflecting elements.

5. The apron drafting arrangement as defined in claim 3, further including a supporting arm, spring means for mounting the top apron guide cage at the supporting arm.

6. The apron drafting arrangement as defined in claim 2, wherein said elastic supporting means comprises a single spring.

7. The apron drafting arrangement as defined in claim 6, further including a pivotal supporting arm movable between a lower and upper pivoted position, said single spring inclining said cage towards the front towards said front rolls when the supporting arm is in its upper pivoted position.

8. The apron drafting arrangement as defined in claim 7, further including means for detachably mounting said cage at said supporting arm and upon detachment of said cage the top intermediate roll is held in said cage by the single spring.

9. The apron drafting arrangement as defined in claim 1, further including exchangeable spacer members for adapting the distance between the upstream located deflecting elements and the downstream located deflecting elements.

10. The apron drafting arrangement as defined in claim 1, further including common lateral guide means provided for both of said aprons.

11. The apron drafting arrangement as defined in claim 10, wherein the lateral guide means is provided at one of the upstream located deflecting elements.

12. The apron drafting arrangement as defined in claim 11, wherein the lateral guide means is provided at the upstream located deflecting element of the bottom apron.

13. The apron drafting arrangement as defined in claim 1, wherein the top intermediate roll comprises a solid roll.

14. The apron drafting arrangement is defined in claim 1, wherein the top intermediate roll comprises a hollow roll.

15. The apron drafting arrangement as defined in claim 1, wherein the top intermediate roll comprises a slip-draft roll.

16. The apron drafting arrangement as defined in claim 1, wherein said means for receiving the top intermediate roll comprises slot means formed in a sidewall of said cage, said slot means being of a size sufficient to movably receive the shaft carrying said intermediate roll.

* * * * *